US005080825A

United States Patent [19]

Bradshaw

[11] Patent Number: 5,080,825

[45] Date of Patent: Jan. 14, 1992

[54] TAPE DRIVE CLEANING COMPOSITION

[75] Inventor: Richard L. Bradshaw, Tucson, Ariz.

[73] Assignee: International Business Machines Corporation, Armonk, N.Y.

[21] Appl. No.: 428,544

[22] Filed: Oct. 30, 1989

[51] Int. Cl.[5] ..... C11D 1/72; C11D 7/00

[52] U.S. Cl. ..... 252/174.21; 252/173; 252/174.22; 252/541; 252/170; 252/70; 252/DIG. 10

[58] Field of Search ..... 252/DIG. 10, 173, 174.22, 252/541, 170, 174.21, 70

[56] References Cited

U.S. PATENT DOCUMENTS 3,839,234 10/1974 Roscoe ..... 252/170
4,343,725 8/1982 Kiewert et al. ..... 252/174.21
4,692,277 9/1987 Siklosi ..... 252/174.21

FOREIGN PATENT DOCUMENTS 0323395 11/1988 European Pat. Off. .

OTHER PUBLICATIONS

Gudjons et al., "Study of Windshield Washer Fluids", Seifen, Oele, Felte, Wachse, 109(7), 204–206, 1983.

*Primary Examiner*—Jack Cooper
*Assistant Examiner*—J. Silbermann
*Attorney, Agent, or Firm*—Manny W. Schecter

[57] ABSTRACT

A water based cleaning composition suitable for use in tape drives including very small quantities of a surfactant, preferably a tridecyl alcohol ether of polyoxyethylene, and an ionic salt of ammonia is disclosed. The quantity of surfactant is such that it is totally water soluble and furthermore does not exist as a free solvent susceptible to evaporation into the environment. The combination of the surfactant and an ionic salt of ammonia, preferably ammonium carbonate, enhances detergency and the suspension of debris without leaving a residue. In addition, the ionic salt of ammonia is provided in a quantity which maintains a neutral pH, thereby minimizing the corrosiveness of the cleaning composition and eliminating static.

19 Claims, 12 Drawing Sheets

SURFACTANT TYPES SUITABLE FOR TAPE CLEANING

| SURFACTANT | SOLUTION (pH) | WETTING | | RESIDUE |
|---|---|---|---|---|
| | | TAPE A | TAPE B | |
| POE (14) LAURATE | 4.5 | = | + | STICKY OIL |
| POE (12) T-OCTYLPHENOL | 3.4 | = | + | OILY |
| POE (16) T-OCTYLPHENOL | 7.3 | = | ++ | WAXY OIL |
| POE (9) NONYLPHENOL | 6.7 | = | = | THIN OIL |
| POE (12) TRIDECYL ALCOHOL | 6.8 | + | ++ | THIN FILM |
| POE (12) DODECYL MERCAPTAN | 3.6 | + | + | TACKY |
| PEG (9) LAURATE | 4.9 | = | + | SLIGHT OIL |
| PEG (14) RICINOLEATE | 6.3 | = | = | TACKY |
| PEG (15) TERTIARY AMINE | 8.9 | = | = | WAXY |
| OLEIC ACID MONOISO-PROPANOL AMIDE | 7.4 | + | + | STICKY |
| POLYGLYCEROL ESTER OF OLEIC ACID | 7.6 | + | + | TACKY |
| SODIUM DIOCTYL SULFO-SUCCINATE | 4.1 | + | + | THIN FILM |
| METHYLDODECYLBENZENE-TRIMETHYL AMMONIUM CHLORIDE | 6.4 | = | = | GRANULAR |

TAPE A- GAMMA IRON OXIDE, CONVENTIONAL IBM 3420 DATA TAPE

TAPE B- CHROMIUM DIOXIDE, IBM 3480 CARTRIDGE TAPE

+ DROPLET COLLAPSES, SPREADS TO GREATER THAN DOUBLE INITIAL DROPLET DIAMETER

= DROPLET COLLAPSES, SPREADS TO ABOUT DOUBLE INITIAL DROPLET DIAMETER

- DROPLET DOES NOT COLLAPSE, ESSENTIALLY SAME DIAMETER

FIG. 1

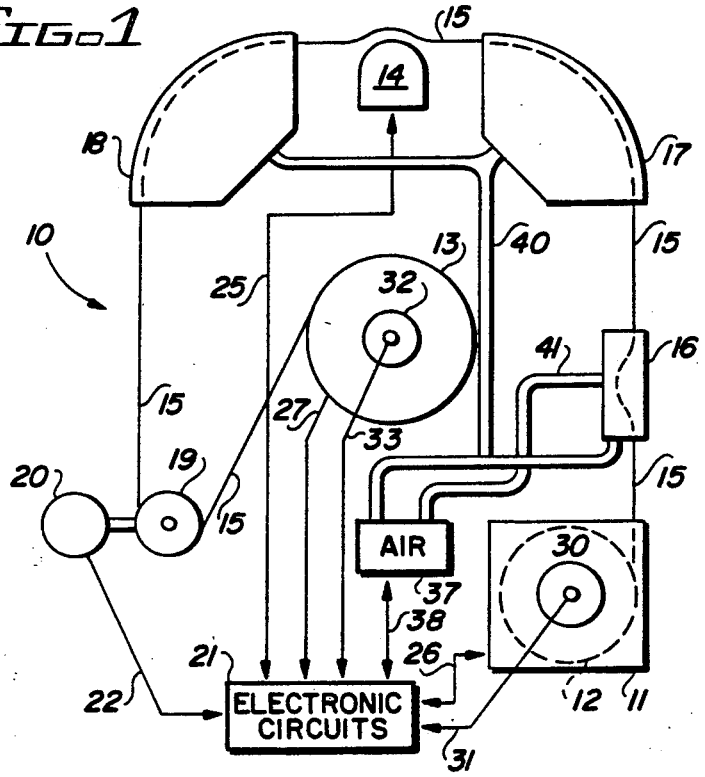

FIG. 2

| WATER-BASED SURFACTANT-SOLUTION PROPERTIES | | |
|---|---|---|
| SURFACTANT | SOLUTION PROPERTIES | |
| | APPEARANCE | pH |
| POLYOXYETHYLENE (POE) DERIVATIVES | | |
| POE (20) OF CASTOR OIL | CLEAR EMULSION | 6.1 |
| POE SORBITAN MONOOLEATE | CLEAR EMULSION | 3.4 |
| POE (14) LAURATE | CLEAR EMULSION | 4.5 |
| POE (20) SORBITAN MONOOLEATE | CLEAR | 5.4 |
| POE (5) OLEAMIDE | CLEAR YELLOW | 7.1 |
| POE (12) T-OCTYLPHENOL | CLEAR EMULSION | 3.4 |
| POE (16) T-OCTYLPHENOL | TRANSLUCENT | 7.3 |
| POE (9) NONYLPHENOL | CLEAR EMULSION | 6.7 |
| POE (6) TRIDECYL ALCOHOL | CLEAR EMULSION | 6.9 |
| POE (12) TRIDECYL ALCOHOL | CLEAR EMULSION | 6.8 |
| POE (12) DODECYL MERCAPTAN | CLEAR EMULSION | 3.6 |
| POE (15) COCO AMINE | CLEAR EMULSION | 8.5 |

| WATER-BASED SURFACTANT-SOLUTION PROPERTIES (CONT.) | | |
|---|---|---|
| SURFACTANT | SOLUTION PROPERTIES | |
| | APPEARANCE | pH |
| POLYETHYLENE GLYCOL (PEG) DERIVATIVES | | |
| PEG (2) LAURATE | INSOLUBLE | 5.9 |
| PEG (4) LAURATE | MILKY | 6.9 |
| PEG (9) LAURATE | CLEAR EMULSION | 4.9 |
| PEG (4) OLEATE | MILKY | 4.6 |
| PEG (9) OLEATE | TRANSLUCENT | 6.7 |
| PEG (4) DIOLEATE | MILKY | 6.0 |
| PEG (4) RICINOLEATE | MILKY | 6.8 |
| PEG (14) RICINOLEATE | CLEAR EMULSION | 6.3 |
| PEG 4 | CLEAR SOLUTION | 7.4 |
| PEG 9 | CLEAR SOLUTION | 7.1 |
| PEG (5) TERTIARY AMINE | INSOLUBLE | 8.4 |
| PEG (15) TERTIARY AMINE | CLEAR EMULSION | 8.9 |
| POLYPROPYLENE GLYCOL (PPG) DERIVATIVES | | |
| PROPYLENE GLYCOL LAURATE | TRANSLUCENT | 6.7 |
| PROPYLENE GLYCOL RICINOLEATE | CLEAR EMULSION | 6.8 |
| PPG (15) | CLEAR SOLUTION | 7.1 |
| AMINES | | |
| OLEIC ACID MONOISOPROPANOL-AMIDE | MILKY | 7.4 |
| N-OLEOYL SARCOSINE | CLEAR EMULSION (POOR SOLUBILITY) | 6.4 |
| COCOAMINE | INSOLUBLE | 9.8 |
| N-COCO-PROPYLENE DIAMINE | TRANSLUCENT | 10.9 |

FIG. 2 (CONT'D.)

WATER-BASED SURFACTANT-SOLUTION PROPERTIES (CONT.)

| SURFACTANT | SOLUTION PROPERTIES | |
|---|---|---|
| | APPEARANCE | pH |
| OTHERS | | |
| POLYGLYCEROL ESTER OF OLEIC ACID | MILKY | 7.6 |
| SULFATED NONYLPHENOL-TETRAETHYLENE GLYCOL ETHER, SODIUM SALT | CLEAR EMULSION (POOR SOLUBILITY) | 2.4 |
| ALKYLAMMONIUM DODECYL-BENZENE SULFONATE | CLEAR EMULSION | 2.8 |
| ALIPHATIC SULFONIC ACID | CLEAR | 4.8 |
| SODIUM DIOCTYL SULFO-SUCCINATE | CLEAR EMULSION | 4.1 |
| POTASSIUM MONOETHYLPHENYL-PHENOL MONOSULFONATE | CLEAR EMULSION | 6.9 |
| SODIUM DI(2-ETHYLHEXYL)-PHOSPHATE | CLEAR EMULSION | 6.9 |
| METHYLDODECYLBENZENE-TRIMETHYL AMMONIUM CHLORIDE | CLEAR EMULSION | 6.4 |
| STEARAMIDOPROPYL, DIMETHYL-B-HYDROXYETHYL AMMONIUM PHOSPHATE | CLEAR | 4.2 |
| QUATERNARY IMIDAZOLINIUM SALT OF COCO ACIDS | CLEAR EMULSION | 3.3 |
| SODIUM SALT OF POLYMERIZED CARBOXYLIC ACIDS | CLEAR | 8.4 |
| AMMONIUM RICINOLEATE | MILKY | 7.6 |
| MORPHOLINE RICINOLEATE | CLEAR EMULSION | 7.4 |
| SULFATED BUTYL OLEATE, SODIUM SALT | CLEAR | 5.5 |
| SODIUM OCTYL SULFATE | CLEAR | 8.2 |
| SODIUM SEC-TETRADECYL SULFATE | CLEAR | 7.9 |

FIG. 2 (CONT'D.)

WATER-BASED SURFACTANT-TAPE WETTING

| SURFACTANT | TAPE WETTING | | RESIDUE |
|---|---|---|---|
| | TAPE A | TAPE B | |
| POLYOXYETHYLENE (POE) DERIVATIVES | | | |
| POE (20) CASTER OIL | = | = | |
| POE SORBITAN MONOLEATE | – | – | |
| POE (14) LAURATE | = | + | STICKY OIL |
| POE (20) SORBITAN MONOOLEATE | – | – | |
| POE (5) OLEAMIDE | = | = | |
| POE (12) T-OCTYLPHENOL | = | + | OILY |
| POE (16) T-OCTYLPHENOL | = | ++ | WAXY OIL |
| POE (9) NONYLPHENOL | = | = | THIN OIL |
| POE (6) TRIDECYL ALCOHOL | + | ++ | SLIGHT FILM |
| POE (12) TRIDECYL ALCOHOL | + | ++ | THIN FILM |
| POE (12) DODECYL MERCAPTAN | + | + | TACKY |
| POE (15) COCOAMINE | – | – | |

TAPE A-GAMMA IRON OXIDE, CONVENTIONAL IBM 3420 DATA TAPE

TAPE B-CHROMIUM DIOXIDE, IBM 3480 CARTRIDGE TAPE

+ DROPLET COLLAPSES, SPREADS TO GREATER THAN DOUBLE INITIAL DROPLET DIAMETER

= DROPLET COLLAPSES, SPREADS TO ABOUT DOUBLE INITIAL DROPLET DIAMETER

– DROPLET DOES NOT COLLAPSE, ESSENTIALLY SAME DIAMETER

FIG. 3

WATER-BASED SURFACTANT - TAPE WETTING (CONT.)

| SURFACTANT | TAPE WETTING | | RESIDUE |
|---|---|---|---|
| | TAPE A | TAPE B | |
| POLYETHYLENE GLYCOL (PEG) DERIVATIVES | | | |
| PEG (4) LAURATE | = | − | |
| PEG (9) LAURATE | = | + | SLIGHT, OILY |
| PEG (4) OLEATE | = | = | |
| PEG (9) OLEATE | = | = | |
| PEG (4) DIOLEATE | = | − | |
| PEG (4) RICINOLEATE | − | = | |
| PEG (14) RICINOLEATE | = | = | TACKY OIL |
| PEG 4 | − | − | |
| PEG 9 | − | − | |
| PEG (15) TERTIARY AMINE | = | = | WAXY |
| POLYPROPYLENE GLYCOL (PPG) DERIVATIVES | | | |
| PROPYLENE GLYCOL LAURATE | − | = | |
| PROPYLENE GLYCOL RICINOLEATE | − | − | |
| PPG (15) | − | = | |

TAPE A - GAMMA IRON OXIDE, CONVENTIONAL IBM 3420 DATE TAPE

TAPE B - CHROMIUM DIOXIDE, IBM 3480 CARTRIDGE TAPE

+ DROPLET COLLAPSES, SPREADS TO GREATER THAN DOUBLE INITIAL DROPLET DIAMETER

= DROPLET COLLAPSES, SPREADS TO ABOUT DOUBLE INITIAL DROPLET DIAMETER

− DROPLET DOES NOT COLLAPSE, ESSENTIAL SAME DIAMETER

FIG. 3 (CONT'D.)

| WATER-BASED SURFACTANT-TAPE WETTING | | | |
|---|---|---|---|
| SURFACTANT | TAPE WETTING | | RESIDUE |
| | TAPE A | TAPE B | |
| AMINES | | | |
| OLEIC ACID MONOISOPROPANOL AMIDE | + | + | STICKY |
| N-OLEOYL SARCOSINE | − | − | |
| N-COCO-PROPYLENE DIAMINE | = | − | |
| OTHERS | | | |
| POLYGLYCEROL ESTER OF OLEIC ACID | + | + | SILGHT TACKY |
| SULFATED NONYLPHENOL-TETRAETHYLENE GLYCOL ETHER, SODIUM SALT | = | + | GRANULAR |
| ALKYLAMMONIUM DODECYL-BENZENE SULFONATE | = | + | OILY |
| ALIPHATIC SULFONIC ACID | − | − | |
| SODIUM DIOCTYL SULFO-SUCCINATE | + | + | THIN FILM |
| POTASSIUM MONOETHYLPHENYL-PHENOL MONOSULFONATE | − | − | |
| SODIUM DI(2-ETHYLHEXYL)-PHOSPHATE | − | − | |

TAPE A- GAMMA IRON OXIDE, CONVENTIONAL IBM 3420 DATA TAPE

TAPE B- CHROMIUM DIOXIDE, IBM 3480 CARTRIDGE TAPE

+ DROPLET COLLAPSES, SPREADS TO GREATER THAN DOUBLE INITIAL DROPLET DIAMETER

= DROPLET COLLAPSES, SPREADS TO ABOUT DOUBLE INITIAL DROPLET DIAMETER

− DROPLET DOES NOT COLLAPSE, ESSENTIALLY SAME DIAMETER

FIG. 3 (CONT'D.)

WATER-BASED SURFACTANT-TAPE WETTING (CONT.)

| SURFACTANT | TAPE WETTING | | RESIDUE |
|---|---|---|---|
| | TAPE A | TAPE B | |
| OTHERS | | | |
| METHYLDODECYLBENZENE-TRIMETHYL AMMONIUM CHLORIDE | = | = | GRANULAR |
| STEARAMIDOPROPYL, DIMETHYL-B-HYDROXYETHYL AMMONIUM PHOSPHATE | - | - | |
| QUATERNARY IMIDAZOLINIUM SALT OF COCO ACIDS | = | = | |
| SODIUM SALT OF POLYMERIZED CARBOXYLIC ACIDS | -- | -- | BEADS UP |
| AMMONIUM RICINOLEATE | - | - | |
| MORPHOLINE RICINOLEATE | - | - | |
| SULFATED BUTYL OLEATE, SODIUM SALT | = | = | |
| SODIUM OCTYL SULFATE | - | - | |
| SODIUM SEC-TETRADECYL SULFATE | - | = | |

TAPE A- GAMMA IRON OXIDE, CONVENTIONAL IBM 3420 DATA TAPE

TAPE B- CHROMIUM DIOXIDE, IBM 3480 CARTRIDGE TAPE

+ DROPLET COLLAPSES, SPREADS TO GREATER THAN DOUBLE INITIAL DROPLET DIAMETER

= DROPLET COLLAPSES, SPREADS TO ABOUT DOUBLE INITIAL DROPLET DIAMETER

- DROPLET DOES NOT COLLAPSE, ESSENTIALLY SAME DIAMETER

FIG. 3 (CONT'D.)

SURFACTANT TYPES SUITABLE FOR TAPE CLEANING

| SURFACTANT | SOLUTION (pH) | WETTING | | RESIDUE |
|---|---|---|---|---|
| | | TAPE A | TAPE B | |
| POE (14) LAURATE | 4.5 | = | + | STICKY OIL |
| POE (12) T-OCTYLPHENOL | 3.4 | = | + | OILY |
| POE (16) T-OCTYLPHENOL | 7.3 | = | ++ | WAXY OIL |
| POE (9) NONYLPHENOL | 6.7 | = | = | THIN OIL |
| POE (12) TRIDECYL ALCOHOL | 6.8 | + | ++ | THIN FILM |
| POE (12) DODECYL MERCAPTAN | 3.6 | + | + | TACKY |
| PEG (9) LAURATE | 4.9 | = | + | SLIGHT OIL |
| PEG (14) RICINOLEATE | 6.3 | = | = | TACKY |
| PEG (15) TERTIARY AMINE | 8.9 | = | = | WAXY |
| OLEIC ACID MONOISO-PROPANOL AMIDE | 7.4 | + | + | STICKY |
| POLYGLYCEROL ESTER OF OLEIC ACID | 7.6 | + | + | TACKY |
| SODIUM DIOCTYL SULFO-SUCCINATE | 4.1 | + | + | THIN FILM |
| METHYLDODECYLBENZENE-TRIMETHYL AMMONIUM CHLORIDE | 6.4 | = | = | GRANULAR |

TAPE A- GAMMA IRON OXIDE, CONVENTIONAL IBM 3420 DATA TAPE

TAPE B- CHROMIUM DIOXIDE, IBM 3480 CARTRIDGE TAPE

+ DROPLET COLLAPSES, SPREADS TO GREATER THAN DOUBLE INITIAL DROPLET DIAMETER

= DROPLET COLLAPSES, SPREADS TO ABOUT DOUBLE INITIAL DROPLET DIAMETER

- DROPLET DOES NOT COLLAPSE, ESSENTIALLY SAME DIAMETER

FIG. 4

EFFECT OF SURFACTANT CHAIN LENGTH ON TAPE CLEANER EFFICACY

| SURFACTANT | WETTING | | RESIDUE |
|---|---|---|---|
| | TAPE A | TAPE B | |
| POE (6) TRIDECYL ALCOHOL | = | ++ | SLIGHT OILY |
| POE (9) TRIDECYL ALCOHOL | + | ++ | SLIGHT OILY |
| POE (12) TRIDECYL ALCOHOL | + | ++ | SLIGHT VISCOUS |
| POE (15) TRIDECYL ALCOHOL | = | = | WAXY |
| PEG (4) LAURATE | = | – | |
| PEG (9) LAURATE | = | + | SLIGHT OILY |
| PEG (4) RICINOLEATE | – | = | |
| PEG (9) RICINOLEATE | = | = | TACKY |

TAPE A - GAMMA IRON OXIDE, CONVENTIONAL IBM 3420 DATA TAPE

TAPE B - CHROMIUM DIOXIDE, IBM 3480 CARTRIDGE TAPE

+ DROPLET COLLAPSES, SPREADS TO GREATER THAN DOUBLE INITIAL DROPLET DIAMETER

= DROPLET COLLAPSES, SPREADS TO ABOUT DOUBLE INITIAL DROPLET DIAMETER

– DROPLET DOES NOT COLLAPSE, ESSENTIALLY SAME DIAMETER

FIG. 5

WATER-BASED SURFACTANT-EFFECT OF DILUTION

POLYOXYETHYLENE (12) TRIDECYL ETHER

| CONCENTRATION (WEIGHT %) | WETTING | | RESIDUE |
|---|---|---|---|
| | TAPE B | TAPE C | |
| 0.400 | ++ | ++ | EXCESSIVE |
| 0.200 | ++ | + | OILY |
| 0.100 | ++ | + | OILY |
| 0.050 | ++ | + | THIN FILM |
| 0.020 | + | + | THIN FILM |
| 0.010 | + | + | SLIGHT |
| 0.005 | + | + | SLIGHT |
| 0.002 | = | = | NONE |
| 0.001 | = | = | NONE |
| 0.0005 | - | - | NONE |

TAPE B-CHROMIUM DIOXIDE, IBM 3480 CARTRIDGE TAPE FORMULATION 1

TAPE C-CHROMIUM DIOXIDE, IBM 3480 CARTRIDGE TAPE FORMULATION 2

+ DROPLET COLLAPSES, SPREADS TO GREATER THAN DOUBLE INITIAL DROPLET DIAMETER

= DROPLET COLLAPSES, SPREADS TO ABOUT DOUBLE INITIAL DROPLET DIAMETER

- DROPLET DOES NOT COLLAPSE, ESSENTIALLY SAME DIAMETER

FIG. 6

| WATER-BASED SURFACTANT-EFFECT OF DILUTION | | | |
|---|---|---|---|
| POLY(ETHYLENE GLYCOL) (14) ESTERS | | | |
| CONCENTRATION | WETTING | | RESIDUE |
| | TAPE B | TAPE C | |
| LAURATE | | | |
| 0.400 | = | = | EXCESSIVE WAXY |
| 0.100 | = | = | |
| 0.050 | = | = | |
| 0.010 | - | - | WAXY RING |
| 0.005 | - | - | |
| 0.0005 | -- | -- | FAINT RING |
| OLEATE | | | |
| 0.400 | + | + | EXCESSIVE WAXY |
| 0.100 | = | = | |
| 0.050 | = | = | |
| 0.010 | - | - | WAXY RING |
| 0.005 | - | - | |
| 0.0005 | -- | -- | FAINT RING |
| RICINOLEATE | | | |
| 0.400 | + | + | OILY RING |
| 0.100 | = | + | |
| 0.050 | = | + | RING, OILY DROPLETS |
| 0.010 | = | = | |
| 0.005 | - | = | |
| 0.0005 | - | - | VERY SLIGHT RESIDUE |

TAPE B- IBM 3480 CARTRIDGE TAPE FORMULATION 1

TAPE C- IBM 3480 CARTRIDGE TAPE FORMULATION 2

+ DROPLET COLLAPSES, SPREADS TO GREATER THAN DOUBLE INITIAL DROPLET DIAMETER

= DROPLET COLLAPSES, SPREADS TO ABOUT DOUBLE INITIAL DROPLET DIAMETER

- DROPLET DOES NOT COLLAPSE, ESSENTIALLY SAME DIAMETER

FIG. 6
(CONT'D.)

EFFECT OF IONIC SALT ADDITION TO DILUTE SURFACTANT SOLUTION

| CONCENTRATION | | WETTING | | |
|---|---|---|---|---|
| $(NH_4)_2CO_3$ | POE(12)TDE | TAPE B | TAPE C | pH |
| 0.00% | 0.0005% | – | – | 4.8 |
| 0.02% | 0.0005% | = | = | 7.5 |
| 0.02% | 0.02% | + | + | 7.6 |
| 0.01% | 0.02% | + | + | 7.3 |

TAPE B - CHROMIUM DIOXIDE, IBM 3480 CARTRIDGE TAPES FORMULATION 1

TAPE C - CHROMIUM DIOXIDE, IBM 3480 CARTRIDGE TAPES FORMULATION 2

+ DROPLET COLLAPSES, SPREADS TO GREATER THAN DOUBLE INITIAL DROPLET DIAMETER

= DROPLET COLLAPSES, SPREADS TO ABOUT DOUBLE INITIAL DROPLET DIAMETER

– DROPLET DOES NOT COLLAPSE, ESSENTIALLY SAME DIAMETER

FIG. 7

FIG. 8

WATER-BASED TAPE CLEANER – CORROSION OF THIN FILM MAGNETIC RECORDING HEAD

| READ MODULE # | RESISTANCE AFTER CONTACT WITH WATER-BASED CLEANER* FOR 10 DAYS @ 45°C | |
|---|---|---|
| | CHANGE IN OHMS | % CHANGE |
| 1 | +0.28 | 0.2 |
| 2 | -0.37 | 0.3 |
| 3 | -0.16 | 0.1 |
| 4 | -0.31 | 0.3 |
| 5 | -0.32 | 0.3 |

*WATER SOLUTION CONTAINING 0.1% $(NH_4)_2CO_3$ AND 0.1% POLYOXYETHYLENE (12) TRIDECYL ETHER BY WEIGHT

TAPE DRIVE CLEANING COMPOSITION

BACKGROUND OF THE INVENTION

1. Field of the Invention

This invention relates to a water based cleaning composition. More particularly, the water based cleaning composition is one suitable for use in a tape drive.

2. Description of the Related Art

Magnetic tape is used to store information for audio and/or video recording, or for data processing applications. The tape typically consists of a substrate such as polyethylene terephthalate coated with gamma iron oxide, chromium dioxide, or other magnetic particles. The magnetic particles include microscopic areas known as "domains" which have a magnetic orientation in a particular direction. Information is recorded on the tape by intentionally orienting the domains in a precise pattern. A recording code is used to determine the pattern. For example, in digital data processing consisting only of logical zeroes and logical ones, the orientation of a domain in one direction could represent a logical zero and the orientation of a domain in the opposite direction could represent a logical one. Numerous recording codes are known. Information is recalled from the tape using the same recording code as that for recording.

The orientation of domains on magnetic tape is accomplished using a read/write "head". The head includes one or more transducers arranged so as to read and write in parallel tracks on a single magnetic tape, thereby increasing the density of stored information. A transducer includes a small core gap formed by a pair of core pieces with a coil mounted on one core piece. Excitation currents provided to the coil produce magnetic field lines that diverge from the gap to penetrate the tape in proximity thereto and orient the domains. The tape is stored on one or more reels, often contained in portable cartridges or cassettes. For the reading and writing of information, the tape must be brought in close physical proximity to the head. The portion of the tape drive in which the tape extends away from the reels to achieve such proximity to the head is known as the "tape path".

A typical tape path, such as that used in the IBM 3480 Tape Drive, is shown in FIG. 1. A magnetic tape containing cartridge 11 is removably installed at one corner of a tape drive 10. The magnetic tape 15 is wound on a tape reel 12 and includes a free end portion which can be removed from cartridge 11. The free end portion of tape 15 is automatically transported to a machine reel 13. A set of electronic circuits 21 control the rotation of reels 12 and 13 via two connections 26 and 27. Two tachometer wheels 30 and 32 provide rotational speed indicating signals to electronic circuits 21 via two connections 31 and 33.

The tape path between reel 12 and reel 13 includes a controller 16, two arcuate guides 17 and 18, a magnetic transducing head 14, and a tension idler wheel 19. Controller 16 regulates tape 15 as it is transported between reel 12 and head 14. An air supply 37 exhausts air from controller 16 through a conduit 41 for providing a vacuum chamber used in connection therewith. Arcuate guides 17 and 18 are air bearing such that positive pressure is exerted by tape 15 onto the tape-facing surface of head 14 for ensuring adequate exchange of signals between the magnetic coating on tape 15 and head 14. An air supply 37 and a conduit 40 supplies air under pressure to arcuate guides 17 and 18. Electronic circuits 21 also control the operation of air supply 37 via control lines 38. Tension idler wheel 19 is supported by a tension transducer 20 for indicating the sensed tension of tape 15 as it is being transported or held to electronic circuits 21 via a connection 22. Electronic circuits 21 thus control the movement of tape 15 between reels 12 and 13. In addition, electronic circuits 21 control the transfer of information between head 14 and tape 15. A bus 25 transfers signals between head 14 and tape 15.

Contaminants are known to accumulate in tape paths and thereby degrade performance. Performance degradation occurs in a variety of ways. The presence of contaminants between the tape and the head may interfere with the ability of the head to magnetically read and write information. The contaminants may also act as an abrasive which physically degrades the surface qualities of the tape or the head during tape movement. In addition, the contaminants may act to degrade other components of the tape path, such as those required for proper tape guidance, and cause them to function improperly.

Contaminants can reach the tape path in several ways. First, contact between the tape and various guidance portions of the tape path, including the head itself, may result in abrasion of the tape. Abrasion may also result from contact between the tape and contaminants themselves. Such abrasion results in tape debris, typically organic in nature, which tends to accumulate in certain areas of the tape path. Another source of contaminants is the surrounding environment. Airborne particles such as dust may settle on various components of the tape path. Finally, although not recognized before, cleaning compositions theoretically used to remove contaminants from tape drives may themselves leave residues.

Current cleaning methodology requires the use of solvent based fluids for the wet cleaning of tape drive components. Solvent based cleaners available throughout the world are constructed from mixtures of organic solvents. Polar degreasing solvents such as alcohols are typically used, but are quite flammable. The alcohols are thus often mixed with a fluorinated solvent to reduce the flammability of the cleaner. Fluorinated solvents, also known as chlorofluorocarbons (CFCs), have been associated with the decreasing thickness of the earth's ozone layer, thereby resulting in global warming.

An example of a tape drive cleaner including the aforementioned organic solvents is that used for the entire family of tape drives marketed by IBM Corporation (IBM). The tape cleaner currently used and recommended by IBM consists of about 64.7 weight % of 1,1,2-trichloro,1,2,2-trifluoroethane, about 35 weight % of isopropyl alcohol, and about 0.3 weight of nitromethane. In recent years, such organic solvents have become increasing targets of worldwide legislative control. The use of the solvents is gradually being limited because of the health and environmental concerns associated therewith.

Water based cleaning compositions inherently eliminate the health and environmental concerns associated with the use of organic solvents. However, the efficacy of water alone as a cleaner of organic residue is quite poor. Water based cleaning compositions therefore require additives to enhance detergency and yet maintain the solubility of salts. These cleaning compositions are designed for the cleaning of smooth, hard, reflective surfaces such as glass, tile, porcelain and other ceramic materials, steel, chrome, brass and other metallic materials, and plastics. Unfortunately, none of the water based cleaning compositions is suitable for use in tape drives, as indicated in the following paragraphs.

U.S. Pat. No. 3,173,876 discloses a water based cleaning composition consisting of less than 12 weight % ethylenediamine in water. This composition is considered inadequate for contemporary use because of the toxicity of ethylenediamine. In addition, the corrosiveness of ethylenediamine makes it incompatible with a tape drive environment in which even trace amounts of corrosion could severely impact performance. The tiny dimensions of the circuitry in the head make such especially susceptible to interference from corrosion. Additional additives recommended in relatively high levels, such as sodium phosphates and sodium borates, may further contribute to the corrosiveness of the composition. These additives are non-volatile and may therefore produce residues which are contaminants.

U.S. Pat. No. 3,463,735 discloses a water based cleaning composition including a surfactant such as a polyethylene oxide ether of fatty alcohol. The composition also includes 0.5 to 5.0 weight % organic alcohol and 0.5 to 5.0 weight % glycol. These components combine to increase lubricity, thereby making the wiping motion necessary for the application and removal of the composition relatively easy. However, lubricity is achieved by a residue left behind upon drying, a source of contaminants to be avoided in the tape drive environment. Although the organic solvents are not the primary components of the cleaning composition, they are still potentially subject to legislative controls. The preferred compositions also include sulfates and/or phosphates which again may be too corrosive for use in tape drives. Thus, none of the specified compositions are suitable for use in tape drives.

U.S. Pat. No. 4,213,873 discloses a water based cleaning composition including 0.3 weight % ammonium hydroxide and about 0.1 weight % of polyethylene glycol The use of ammonium hydroxide again makes the composition too basic and corrosive for use in tape drives. Additional compositions are disclosed but include organic alcohol solvents which should be avoided, as previously stated. Some of the additional compositions also include ammonium carbonate or ammonium bicarbonate as a lubricity agent. Although the weight % of such compounds is only about 0.025 to 0.3, they are used only in combination with substantial amounts of surfactants and alcohol solvents. There is no teaching of how to successfully clean an organic contaminant without using alcohol solvents and/or other problematic additives.

As the sophistication of tape drives increases, the need to avoid the disadvantages of the aforementioned cleaning compositions will also increase. Smaller circuitry will be required as the density of information stored on magnetic tape increases. Storage tracks currently about 400 micrometers in width may be reduced an order of magnitude. The effect of contamination or corrosion is almost certain to be catastrophic at such dimensions. Residues must be reduced. Finally, static electricity must be eliminated to prevent contaminants from resettling in the tape drive as the wiper used is removed after cleaning. Prior cleaning compositions do not adequately address static. A tape drive cleaning composition resolving the aforementioned problems would almost certainly be advantageous in general purpose use as well.

SUMMARY OF THE INVENTION

In view of the foregoing, it is the principle object of this invention to improve cleaning compositions.

Another object of this invention is a cleaning composition without materials which are the target of legislative limitations.

Yet another object of the invention is a cleaning composition which provides improved detergency.

Yet another object of the invention is a cleaning composition which is not corrosive.

Yet another object of the invention is a cleaning composition which minimizes the residue remaining after use.

Yet another object of the invention is a cleaning composition which controls static electricity.

Yet another object of the invention are the aforementioned improved cleaning compositions which are otherwise suitable for use in tape drives.

These and other objects are accomplished by a water based cleaning composition including very small quantities of a tridecyl alcohol ether of polyoxyethylene or a tridecyl alcohol ester of polyethylene glycol surfactant and an ionic salt of ammonia. None of these additives are considered to pose a health or environmental concern, particularly at the very small concentrations (less than 0.3 weight %) required. The tridecyl alcohol ethers of polyoxyethylene or tridecyl alcohol esters of polyethylene glycol containing greater than 6 moles of ethylene oxide or ethylene glycol, respectively, are water soluble with such solubility increasing as the moles of ethylene oxide increase. The melting point of the material also increases, however, as the moles of ethylene oxide or ethylene glycol increase, resulting in waxy residues for molar amounts above 15. A surfactant moiety comprised of 11–12 moles of ethylene oxide or ethylene glycol has been found to be acceptable for the purpose of balancing the desired water solubility with the required physical properties of the residue. The residue remaining upon evaporation of the water is a viscous liquid with excellent lubrication properties and which by virtue of its high boiling point does not evaporate and is non-polluting.

The addition of an ionizable, inorganic salt to the surfactant-water mixture has been found to enhance the detergency of the mixture and the conductivity of the medium so as to permit improved static charge dissipation. The use of a weakly basic salt offsets the weak acidity of the surfactant to produce a neutral solution, thereby minimizing the risk of acid/base corrosion of the sensitive metal surfaces present in magnetic recording devices. Because most ionic species are hard, crystalline solids which could constitute an undesirable abrasive when introduced into the head/tape interface employed in magnetic recording technology, ionic salts of gases such as ammonium carbonate and ammonium bicarbonate are preferred. These salts provide the desired ionic character in water solution, yet decompose to volatile gases upon drying. Thus, the efficacy of the cleaning composition is enhanced without additional contamination of the recording surfaces during subsequent operation of the tape path.

The foregoing and other objects, features, and advantages of the invention will be apparent from the following more particular description of the preferred embodiment of the invention, as illustrated in the accompanying drawing.

BRIEF DESCRIPTION OF THE DRAWINGS

FIG. 1 is a plan view of a typical tape path.

FIG. 2 is a table showing the solution properties of water-based surfactants.

FIG. 3 is a table showing the tape wetting properties of water-based surfactants.

FIG. 4 is a table summarizing the properties of some of the surfactants shown in FIGS. 2-3.

FIG. 5 is a table showing the effect of the surfactant chain length on tape wetting properties.

FIG. 6 is a table showing the effect of dilution of the surfactant on tape wetting properties.

FIG. 7 is a table showing the effect of adding an ionic salt of ammonia to a surfactant on certain tape cleaning properties.

FIG. 8 is a table showing the corrosion properties of a cleaning composition according to the invention in a tape drive environment.

DESCRIPTION OF THE PREFERRED EMBODIMENT

A water based cleaning composition including 0.0005 to 0.2 weight % of a tridecyl alcohol ether of polyoxyethylene or of a tridecyl alcohol ester of polyethylene glycol and 0.001 to 0.1 weight % of an ionic salt of ammonia will be described. The additives are completely dissolved in the water (distilled water). The elimination of free organic solvents and chlorofluorocarbons removes concerns associated with flammability and the ozone layer. The components are inexpensive and readily available in commercial quantities. The combination of detergency without the aforementioned concerns of previous cleaners, including those associated with a tape drive environment, addresses a long and increasingly felt need.

Potentially useful surfactants for incorporation into a water-based tape drive cleaning composition should be very soluble in water, non-corrosive, non-toxic, non-flammable, and either volatile so as to leave no residue or low melting, liquid materials suitable as tape lubricants if potentially present as a residue. The group of surfactants derived from polyoxyethylene ethers of hydrocarbon alcohols have been found to best meet these requirements. Since these materials are non-volatile, additional selection based on lubricity of the potential residues was made.

As taught by U.S. Pat. No. 4,303,738, hereby incorporated by reference, tridecyl stearate was found to be a particularly good lubricant for very smooth media. The material used consisted of a mixture of isomers of tridecyl alcohol esters of stearic, palmitic and myristic acids. The mixture is a low melting liquid whose purified components are waxy solids. These lubricant materials are neither water soluble nor useful as surfactants. The replacement of the fatty acid portion of these lubricants with polyoxyethylene, however, renders the long chain hydrocarbon alcohol water soluble. These aliphatic alcohol ethers of polyoxyethylene have been found to be excellent wetting agents for the surfaces typically present in magnetic recording devices.

Of the various surfactants which contain polyoxyethylene as a major constituent, only those possessing the appropriate balance of hydrocarbon character and water miscibility have been found to be satisfactory for use as a magnetic recording device cleaner. The designation of these surfactants as derivatives of polyoxyethylene is made for convenience. It is common practice in industrial product nomenclature to name the material so as to designate its mode of synthesis. The names polyoxyethylene and polyethylene glycol are thus synonymous for the same chemical structure. Each describes the route of construction, however, as using either ethylene oxide or ethylene glycol as the starting material respectively. The materials obtained differ only in the composition of contaminants and the distribution of isomers. The remaining discussion will generally focus on polyoxyethylene, but it should be understood that similar information exists for polyethylene glycol.

The chemical formula for the alcohol ethers of polyoxyethylene is $[CH_3(CH_2)_m]\text{-}(OCH_2CH_2)_nOH$ where $(m+1)$ is the number of carbons present in the alcohol portion. Values of "m" between 9-12 provide a surfactant with sufficient organic character to disperse the typical lubricants present in a typical tape path. A mixture of the isomers of tridecyl alcohol ($m=12$) is particularly useful due to its adequate miscibility with conventional tape lubricants and its similarity to existing lubricant materials. The average number of polyethylene oxides present in the polyoxyethylene segment of the molecule is designated by the values of "n", which are typically 6-15. For $n=6$, the surfactants are liquids, but have limited solubility in water. For $n=15$ the surfactants are semi-solid waxes with very good solubility in water. Values of $n \approx 8\text{-}12$ have been found to produce an optimum water solubility without solidification.

Examples of the tridecyl alcohol ethers of polyoxyethylene are available in liquid form from ICI Americas, Inc. (RENEX and AHCOWET series), the Emery Division of Qunatum Chemical Corporation (TRYCOL TDA series), Witco Chemical Company (WITCONOL SN series), Union Carbide Corporation (TERGITOL 15-S-9 and 25-L-5 series), and PPG Industrial Chemicals Group (MACOL TD series).

To provide a weak electrolyte for the purpose of static charge dissipation during cleaning, it has been found useful to introduce very small amounts of an ionizable salt into the surfactant-water mixture. The added salt is selected so as to minimize corrosion and residue generation while still providing enhanced cleaning. Salts of volatile weak bases such as ammonia with weak acids such as carbonic, acetic, boric and phophoric acids have been found to be suitable at concentrations well below 0.1%. The salts of ammonium carbonate and ammonium bicarbonate are particularly suited to this application by virtue of their decomposition to yield only gaseous products, i.e. ammonia, water and carbon dioxide.

Ammonium carbonate is a colorless, crystalline solid which decomposes slowly at room temperature to produce ammonia and ammonium bicarbonate. Ammonium carbonate is available from J. T Baker Chemical Corporation, BASF Wyndotte Corporation, Harshaw Chemical Company and many other chemical manufacturers worldwide. Ammonium bicarbonate is a white, powdery solid which decomposes slowly at room temperature and quickly at 60° C. liberating ammonia, water and carbon dioxide Ammonium bicarbonate is available from a number of commercial sources such as Allied Chemical Corporation, Kraft Chemical, Sobin Chemicals Incorporated and Intsel Corporation.

The cleaning compositions are produced by simple mixing. The order of mixing is not important. No stirring is required as the constituents are added to distilled water to effect dissolution. The polyoxyethylene tridecyl ether surfactants are weakly acid in dilute aqueous solution with a pH of 4.0–5.0. The addition of small amounts of weakly basic ionizable salts such as ammonium carbonate produces a clear water solution with a pH range of 7.2–7.9. The dilute buffer solution thus prepared minimizes the risk of acid or base induced corrosion which could be aggravated by cleaning with water or aqueous surfactants only. The ionic salt acts as an electrolyte in water solution and thus yields the added benefit of improved static charge dissipation during the usual cleaning process.

The cleaning compositions are compatible with ceramic materials such as ferrite and alumina as well as the metals, rubbers and plastics commonly used in tape drives. In addition, the composition does not harm the materials commonly used to construct magnetic tapes. Finally, the quantities of the additives to water required to permit adequate tape drive cleaning are so low as to render the final composition effectively 99.9% water and thereby effectively eliminate safety and health concerns.

Other relatively inert components may be added to the cleaning composition for additional function. For example, pH sensitive indicators such as bromothymol blue can be added to provide color to the formulation while at the same time providing an internal monitor of the pH of the mixture.

The pH is monitored by visually inspecting the color (blue) of the solution. Loss of the ammonium carbonate or failure to incorporate such into the formulation would result in the change in the solution color to yellow. Although such function may at times be advantageous, it is preferred that such additives be omitted to minimize the potential for unnecessary residue deposition in the tape path.

The preferred cleaning composition is about 99.97 weight % of water, about 0.01 weight % of a tridecyl alcohol ether of polyoxyethylene, and about 0.02 weight % of ammonium carbonate. Residues were found after the use of compositions including amounts above 0.2 weight % of a tridecyl alcohol ether of polyoxyethylene. Below 0.0005 weight % of a tridecyl alcohol ether of polyoxyethylene the detergency of the composition was found to be inadequate. Also, residues were found after the use of compositions including amounts above 0.1 weight % of ammonium carbonate. Below 0.001 weight % of ammonium carbonate the wetting of the surface to be cleaned was found to be inadequate.

The evaluation of potentially useful surfactant materials was carried out by the preparation of 0.2 weight % aqueous solutions of various water soluble, liquid surfactant materials representative of a wide range of materials. The solutions were screened on the basis of clarity, pH, and wetting properties. The ability of the solutions to wet a tape surface was evaluated using two representative tape samples One sample was a conventional iron oxide pigmented tape, the other sample was a chromium dioxide based tape with significantly different surface attributes. Wetting efficiency was qualitatively assessed by placing a drop of solution on each tape surface and observing the flowout of the droplet thereon. The droplet was allowed to air dry and the area upon which the drop had been placed was checked using a low power microscope to check for the existence of any residue. The results of these tests are summarized in FIGS. 2–3.

FIG. 2 lists the solution properties according to the surfactant used. The desired properties were a clear emulsion, for detergency, and as neutral a pH as possible to provide some buffering against potential corrosion. Short length polyoxyethylene or polyethylene glycol chains were found to be of unsatisfactory detergency. (The length of the polyoxyethylene or polyethylene glycol portion of the surfactant molecule, expressed in average moles, is shown in the drawing in parentheses for each applicable surfactant.) The presence of added polar functionality such as carboxylic acid, sulfate, mercaptan, or amine was found to produce undesirable solution pH. Simple polyoxyethylene or polyethylene glycol, without the addition of a hydrophobic part, resulted in neutral solutions without any evidence of emulsion formation (i.e. no detergency was found). Surfactants having as their hydrophobic part both aliphatic structures and non-aliphatic structures, such as octylphenol and nonylphenol ethers of polyoxyethylene, resulted in clear emulsions with moderate solution pH.

FIG. 3 lists the wetting properties of some of the surfactants, including those characterized as most desirable, listed in FIG. 1. The desired properties were adequate tape wetting on both tape samples and an absence of residue. Generally, the preferred order of characterization of residue from best to worst was none, thin film, oily, waxy or granular, tacky, and sticky. Simple hydrophilic structures did not achieve the desired wetting of tape surfaces. It is thus evident that the use of polyoxyethylene or analogous materials without the addition of a hydrophobic part is ineffective as a cleaning composition.

FIG. 4 summarizes the potentially useful materials from FIGS. 2–3. Several factors indicated a preference for polyoxyethylene or polyethylene glycol derivatives of aliphatic long chain alcohols. Despite similar behavior exhibited by the alkyl substituted aromatics, such as t-octylphenol and nonylphenol, these aromatic materials displayed greater variability in the pH than their aliphatic analogues. The aromatic analogues were thus considered suitable for tape cleaner formulations, but not as desirable as the aliphatic derivatives of polyoxyethylene.

FIG. 5 shows the effect of polyoxyethylene or polyethylene glycol chain length on tape cleaner efficacy. The optimum chain length of the surfactant molecule, expressed as average moles of ethylene oxide or ethylene glycol, was evaluated for a series of aliphatic polyoxyethylene and polyethylene glycol materials respectively. In general, chain lengths in excess of 6 were required to achieve solubility for polyoxyethylene (POE). For polyethylene glycol (PEG), chain lengths in excess of 4 were required for adequate solubility. PEG (4) is approximately the same as POE (4-6), PEG (9) is approximately the same as POE (8-10), etc Wetting was adequate for chain lengths of POE (6-15) and PEG (4-14), but was reduced for chain lengths greater than 12 for polyoxyethylene. The optimum surfactant appeared to be a tridecyl alcohol derivative of a polyoxyethylene with a chain length of 8–12.

The effect of the dilution of the surfactant was studied as it impacted the wetting behavior for two chromium dioxide based tapes of significantly different formulations and surface properties. Several surfactants were studied. The results of the study for POE (12) tridecyl ether and PEG (14) laurate are presented in FIG. 6. The results indicate that the wetting characteristics improve, and the residue characteristics worsen, as the surfactant concentration increases. The useful range which allows for acceptable wetting of tape surfaces while depositing a minimum of residue is from 0.001 to 0.200 weight % surfactant.

The effect of the addition of ionic salts to dilute surfactant solutions was also studied, again as it impacted two different chromium dioxide based tapes. The results of the study for ammonium carbonate and POE (12) tridecyl ether are shown in FIG. 7. Similar results can be obtained for ammonium bicarbonate as it reduces to the same subcomponents ammonium carbonate in water. The results indicate that the addition of ammonium carbonate broadens the acceptable range of surfactant concentration to 0.0005 to 0.200 weight % and that the concentrations for maximizing tape wetting are approximately 0.02 weight % of both the salt and the surfactant. In practice, a slightly lower 0.01 weight % concentration of the surfactant is preferred to further reduce the amount of residue.

The corrosion resistance of the water based tape cleaner was aggressively tested by placing state-of-the-art, thin film, magneto-resistive magnetic recording heads in contact with the cleaning composition under extreme conditions of temperature and humidity. The tests included measurement of the resistance in the read and write elements both before and after exposure to a concentrated solution (0.1 weight % ammonium carbonate and 0.1 weight % tridecyl ether of polyoxyethylene) at a temperature of 45 degrees Centigrade. Contact was maintained by placing the magnetic head surface on a cotton cloth soaked with the solution in a petri dish. The liquid level was maintained by the periodic addition of fresh surfactant solution. Resistance measurements were made between the read and write elements of the magnetic head.

In general, changes of several ohms of resistance are associated with the onset of corrosion of magnetic head devices. As indicated by the test results presented in FIG. 8, the devices showed no significant increase in resistance after ten days of exposure. The reproducibility of the resistance measurements, without any exposure to corrosive materials, is typically plus or minus 0.5%. The change in resistance after ten days of exposure, as noted in FIG. 8, was around 0.1–0.4% and was thus within the reproducibility of the measurements. There thus appears to be no risk to a magnetic head from extended exposure to the appropriate water based cleaning composition.

The cleaning compositions are applied in the usual ways. The preferred method of application is by first wetting a cloth and then wiping the surface to be cleaned. The compositions may also be poured or sprayed directly onto the surface and then wiped dry. Pouring is preferred to avoid bubbling Any clean, chloride free cloth may be used, although lint free or non-woven polypropylene varieties are preferred in the dust sensitive tape drive environment. In hard to reach areas a cotton swab or the equivalent may be used so long as the water leechable content therein has been shown to be minimal. The compositions have been found to be effective in cleaning metals, glasses and other ceramics, rubbers, and plastics, including those typically found in tape drives. In addition, the cleaning compositions can be used to gently remove debris directly from the surface of magnetic tape as it will not remove or otherwise degrade the magnetic coating of the tape.

While the invention had been described with respect to a preferred embodiment thereof, it will be understood by those skilled in the art that various changes in detail may be made therein without departing from the spirit, scope, and teaching of the invention. For example, although the cleaning compositions described herein have been evaluated particularly with respect to use in a tape drive, other uses are clearly applicable. The cleaning compositions could be used on any of the materials described, but in another environment—such as for the cleaning of glass windows. Such cleaning would be improved by the elimination of residues resulting in streaking, despite the loss of lubricity. Accordingly, the invention herein disclosed is to be limited only as specified in the following claims.

What is claimed is:

1. A cleaning composition comprising:
at least 99.7 weight % of water;
about 0.0005 to 0.2 weight % of a tridecyl ether of polyoxyethylene as a surfactant; and
about 0.001 to 0.1 weight % of a salt of ammonia.

2. The composition of claim 1, wherein the polyoxyethylene portion contains an average of about 6 to 15 moles of ethylene oxide per surfactant molecule.

3. The composition of claim 2 wherein the polyoxyethylene portion contains an average of about 8 to 12 moles of ethylene oxide per surfactant molecule.

4. The composition of claim 1 wherein the salt of ammonia is one selected from the group consisting of ammonium carbonate and ammonium bicarbonate.

5. The composition of claim 4 wherein the weight % of water is about 99.97, the weight % of a tridecyl ether of polyoxyethylene is about 0.01, and the weight % of the salt of ammonia is about 0.02.

6. A cleaning composition comprising:
at least 99.7 weight % of water;
about 0.0005 to 0.2 weight % of a tridecyl ester of polyethylene glycol as a surfactant; and
about 0.001 to 0.1 weight % of a salt of ammonia.

7. The composition of claim 6 wherein the polyethylene glycol portion contains an average of about 4 to 14 moles of ethylene glycol per surfactant molecule.

8. The composition of claim 7 wherein the polyethylene glycol portion contains an average of about 8 moles of ethylene glycol per surfactant molecule.

9. The composition of claim 6 wherein the salt of ammonia is one selected from the group consisting of ammonium carbonate and ammonium bicarbonate.

10. The composition of claim 9 wherein the weight % of water is about 99.97, the weight % of a tridecyl ether of polyoxyethylene is about 0.01, and the weight % of the salt of ammonia is about 0.02.

11. A cleaning composition comprising:
about 0.0005 to 0.2 weight % of one selected from the group consisting of a tridecyl ether of polyoxyethylene and a tridecyl ester of polyethylene glycol as a surfactant;
about 0.001 to 0.1 weight % of a salt of ammonia; and
the remainder being inert components.

12. The composition of claim 11 wherein the salt of ammonia is one selected from the group consisting of ammonium carbonate and ammonium bicarbonate.

13. The composition of claim 11 wherein the weight % of the surfactant is about 0.01, and the weight % of the salt of ammonia is about 0.02.

14. A cleaning composition consisting essentially of:
about 99.7 to 99.9985 weight % of water;

about 0.0005 to 0.2 weight % of one selected from the group consisting of a tridecyl ether of polyoxyethylene and a tridecyl ester of polyethylene glycol as a surfactant; and about 0.001 to 0.1 weight % of a salt of ammonia.

15. The composition of claim 15 wherein the salt of ammonia is one selected from the group consisting of ammonium carbonate and ammonium bicarbonate.

16. The composition of claim 14 wherein the weight % of water is about 99.97, the weight % of the surfactant is about 0.01, and the weight % of the salt of ammonia is about 0.02.

17. A tape drive cleaning composition consisting essentially of:

about 99.7 to 99.9985 weight % of water;

about 0.0005 to 0.2 weight % of one selected from the group consisting of a tridecyl ether of polyoxyethylene and a tridecyl ester of polyethylene glycol as a surfactant; and about 0.001 to 0.1 weight % of a salt of ammonia.

18. The composition of claim 17 wherein the salt of ammonia is one selected from the group consisting of ammonium carbonate and ammonium bicarbonate.

19. The composition of claim 17 wherein the weight % of water is about 99.97, the weight % of the surfactant is about 0.01, and the weight % of the salt of ammonia is about 0.02.

* * * * *